US007681624B2

(12) United States Patent
Hirata et al.

(10) Patent No.: US 7,681,624 B2
(45) Date of Patent: Mar. 23, 2010

(54) FLASKLESS MOLDING MACHINE

(75) Inventors: Minoru Hirata, Toyokawa (JP); Takayuki Komiyama, Toyokawa (JP); Toshihiko Oya, Toyokawa (JP); Tsuyoshi Sakai, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 368 days.

(21) Appl. No.: 11/896,415

(22) Filed: Aug. 31, 2007

(65) Prior Publication Data

US 2008/0289792 A1 Nov. 27, 2008

(30) Foreign Application Priority Data

May 25, 2007 (JP) ..... 2007-138700

(51) Int. Cl.
*B22C 9/00* (2006.01)
*B22C 9/20* (2006.01)
*B22C 15/24* (2006.01)

(52) U.S. Cl. ..... 164/184; 164/194; 164/201

(58) Field of Classification Search ..... 164/20, 164/29, 184, 194, 201
See application file for complete search history.

(56) References Cited

U.S. PATENT DOCUMENTS 5,246,058 A * 9/1993 Murata ..... 164/182

FOREIGN PATENT DOCUMENTS

EP 1 695 776 A1 8/2006
EP 1 726 382 A1 11/2006
JP 4-66245 3/1992
WO WO 02/43901 A1 6/2002

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

The disclosed invention provides a molding machine that defines upper and lower molding spaces while cope and drag flasks 12,13 and a match plate 11 clamped therebetween are rotated from a horizontal position to a vertical position, and that readily places a core into a lower mold within the drag flask. An upper squeeze member 14 is insertable into the cope flask 12 with its pressure-applying plane being opposed to the upper face of the match plate 11. The pressure-applying plane defines an upper molding space together with the upper face of the match plate 11 and the cope flask 12. A pivoting frame 23 supports the cope and drag flasks 12,13, a match plate 11 clamped therebetween, and the upper squeeze member 14, such that they rotate in unison between a horizontal position, in which the pressure-applying plane of the upper squeeze member 14 is oriented vertically downward, to a vertical position in which the pressure-applying plane is oriented horizontally. A fixed, vertical, filling frame abuts the drag flask 13 when the flasks 12, 13 and the match plate 11 that is clamped therebetween are in the vertical position. A lower squeeze member 16 has a pressure-applying plane that is oriented horizontally, and is insertable into the filling frame and the abutting drag flask 13. The pressure-applying plane of the lower squeeze member 16 defines a lower molding space together with the lower face of the match plate 11, the drag flask 13, and the filling frame 15. To place a core into a lower mold within the drag flask, the drag flask 13 is laterally moved from a position that is immediately beneath the cope flask 12 such that an open working space is provided.

8 Claims, 9 Drawing Sheets

(A)

(B)

(A)

(B)

(A)

(B)

(A)

(B)

FLASKLESS MOLDING MACHINE

FIELD OF THE INVENTION

This invention relates to a molding machine, and more particularly, to one to make upper and lower flaskless molds at the same time.

BACKGROUND OF THE INVENTION

In the flaskless molding method, an attempt has been made to improve work efficiency by using a well-known flaskless molding machine. For example, Japanese Early-Patent Publication No. 04 [denotes the year 1992]-66245 suggests that a well-known flaskless molding machine be combined with a pattern-changing device. The pattern exchanges mechanically and automatically, rather than manually, for a new pattern plate.

However, the publication describes "the arrangement of the main unit 10 of the molding machine is a well-known one that has been used in a so-called flaskless molding method." Clearly, the flaskless molding machine employed as in the disclosure is a well-known one that has been used in a conventional flaskless molding method, where the pattern plates are exchanged manually. Therefore, the processes of defining a pair of molding spaces as in the flaskless molding machine of this disclosure are the same as those in the conventional flaskless molding method, where the pattern plates are manually exchanged. That is, a pattern plate having patterns on both faces is horizontally clamped between a pair of flasks in a sandwich relationship at the side of the molding machine. They are then rotated in unison to a location below a sand-supplying device such that they are vertical. Then a pair of opposed squeeze heads is horizontally inserted in the pair of the vertical flasks, which between them clamp the pattern plate, to define a pair of molding spaces. Accordingly, in the conventional flaskless molding machine the processes of defining a pair of molding spaces could not begin until the cope and drag flasks that clamp the pattern plate therebetween are in the vertical position. Because this situation results in a molding cycle in the conventional flaskless molding machine that still requires much time, the production efficiency of molds is low.

The resulting molds that are produced from the flaskless molding machine are stacked upper and lower molds. Before stacking them a core is often manually placed in the mold within the drag flask. However, in the conventional flaskless molding machine, the cope flask that is located immediately above the drag flask can interfere with an operator who is trying to place the core in the lower mold within the drag flask. Because the conventional flaskless molding machine provides no ready access to an operator who is trying to place the core in the lower mold, it is also a bad factor in the efficiency of making molds of the flaskless molding machine.

SUMMARY OF THE INVENTION

Accordingly, this invention aims to provide a flaskless-molding machine that can shorten the time required for making flaskless molds, and that can increase production efficiency.

The present invention is not limited to whether a molding method applicable to the present molding machine must have a process of placing a core in a lower mold within a drag flask. However, to adapt the present molding machine to readily place the core in that position, if such is necessary, constitutes a part of one object of the present invention.

The present invention provides a molding machine to make a pair of flaskless molds. This molding machine comprises a flask assembly that includes a cope flask, a drag flask, and an exchangeable match plate having upper and lower faces that are formed with patterns; means for relatively moving said cope and drag flasks to the match plate of the flask assembly such that the cope and drag flasks can hold and release the match plate being held therebetween; an upper squeeze member having a pressure-applying plane, wherein said upper squeeze member is insertable into the cope flask of the flask assembly while the pressure-applying plane is opposed to the upper face of the match plate such that an upper molding space is defined by the pressure-applying plane, the upper face of the match plate, and the cope flask; supporting means for supporting the flask assembly and the upper squeeze member, and for rotating them in unison between a horizontal position in which the pressure-applying plane of the upper squeeze member is oriented vertically and facing downward and a vertical position in which the pressure-applying plane is oriented horizontally; a filling frame located to abut the drag flask in a perpendicular position when the flask assembly is in the vertical position; a lower squeeze member having a pressure-applying plane that is oriented horizontally, wherein the lower squeeze member is insertable into the filling frame, and wherein the lower squeeze member is insertable into the drag flask through the filling frame while the pressure-applying plane of the lower squeeze member is opposed to the lower face of the match plate when the flask assembly is in the vertical position such that a lower molding space is defined by the pressure-applying plane, the lower face of the match plates, the filling frame, and the drag flask; an upper actuator to move the upper squeeze member to the upper faces of the match plates such that molding sand within the upper molding space is squeezed by the pressure-applying plane of the inserted upper squeeze member; a lower actuator to move the lower squeeze member to the lower face of the match plate such that molding sand within the lower molding apace is squeezed by the pressure-applying plane of the lower squeeze member; means for carrying in the match plate between the cope flask and the drag flask at the horizontal position, and for carrying the match plate out from therebetween; and means for laterally moving the drag flask relative to the cope flask into the lateral side of the molding machine, after the match plate is carried out from between the cope flask and the drag flask.

Preferably, the upper molding space is defined by the pressure-applying plane of the upper squeeze member, the upper face of the match plate, and the cope flask, while the cope and drag flasks, the match plate, and the upper squeeze member are rotated from the horizontal position to the vertical position.

In this case, the lower squeeze member initiates the insertion into the filling frame while the rotation from the horizontal position to the vertical position is carried out. The lower molding space is defined by the pressure-applying plane of the lower squeeze member, the lower face of the match plate, and the drag flask when the filling frame abuts the drag flask.

Each upper or lower actuator may be a hydraulic cylinder, an electric cylinder, or a servo cylinder.

The cope and drag flasks may have sand-filling ports on their side walls for supplying molding sand. Preferably, the molding machine may include means for introducing by air the molding sand into the defined upper and lower molding spaces through the sand-filling ports.

The means for introducing the molding sand may include a fluidizing mechanism for fluidizing the molding sand with an airflow of compressed air.

The molding machine may further comprise means for stripping a pair of the molds from the cope and drag flasks.

Preferably, the means for stripping a pair of the molds includes means for pushing out the molds from the cope flask and the drag flask, which are in a stacked relationship and which contain a pair of the molds.

The above and other features and objects of the present invention are further clarified by the following descriptions that refer to the accompanying drawings.

BRIEF DESCRIPTIONS OF THE DRAWINGS

Figure 1:
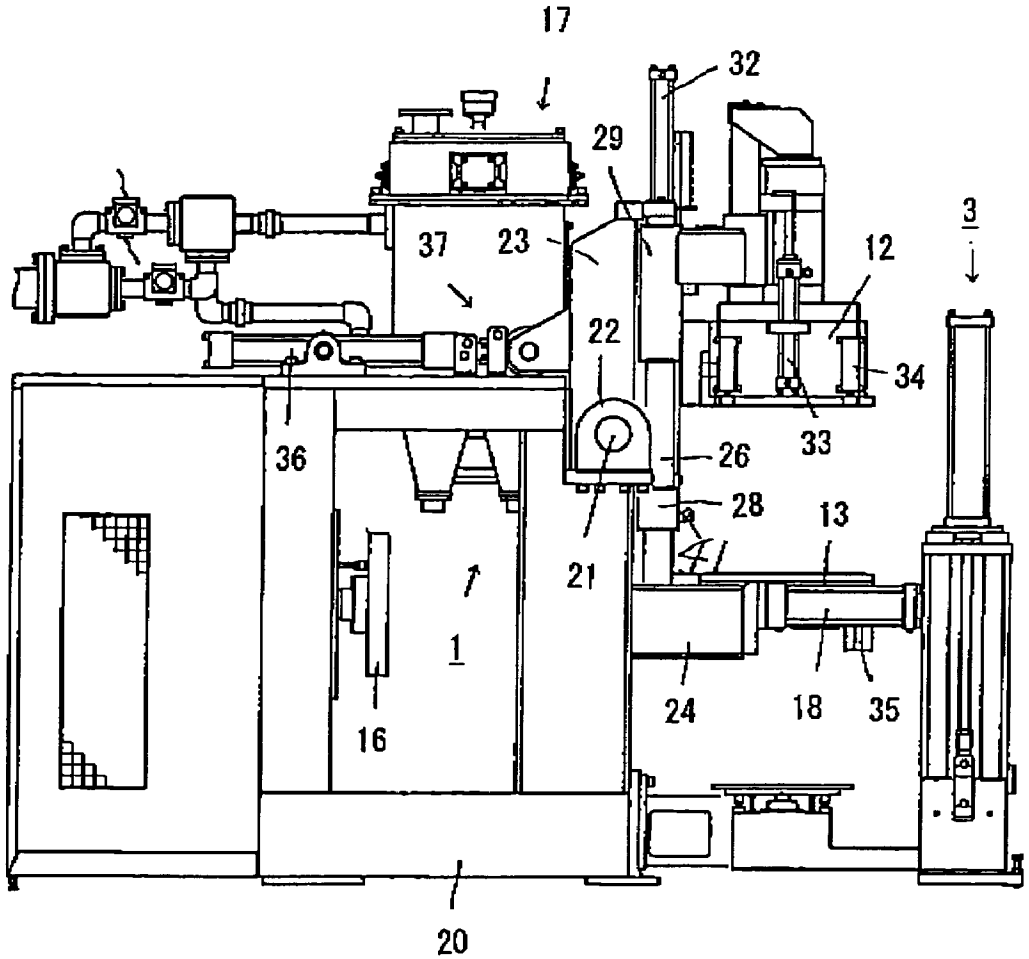
FIG. 1 is a front view of the molding machine of an embodiment of the present invention.
Figure 6:
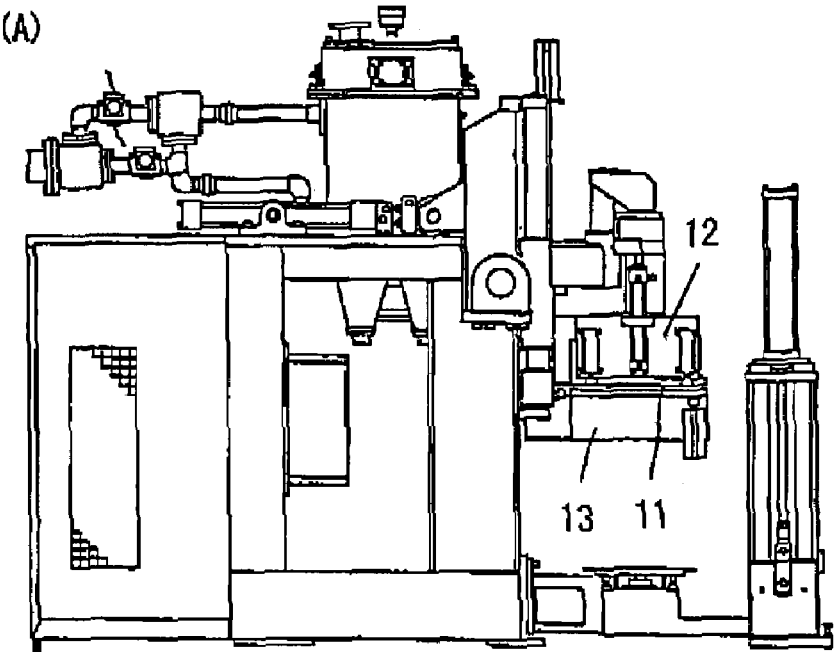
Figure 6:
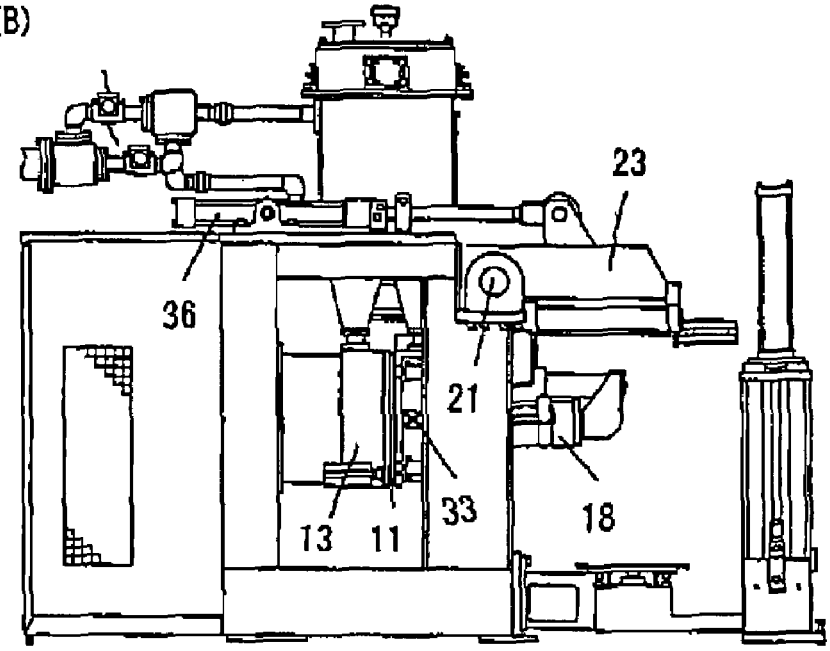

FIGS. 6 (A) and (B) illustrate the continuous process of defining a pair of molding spaces with the molding machine of FIG. 1.

Figure 7:
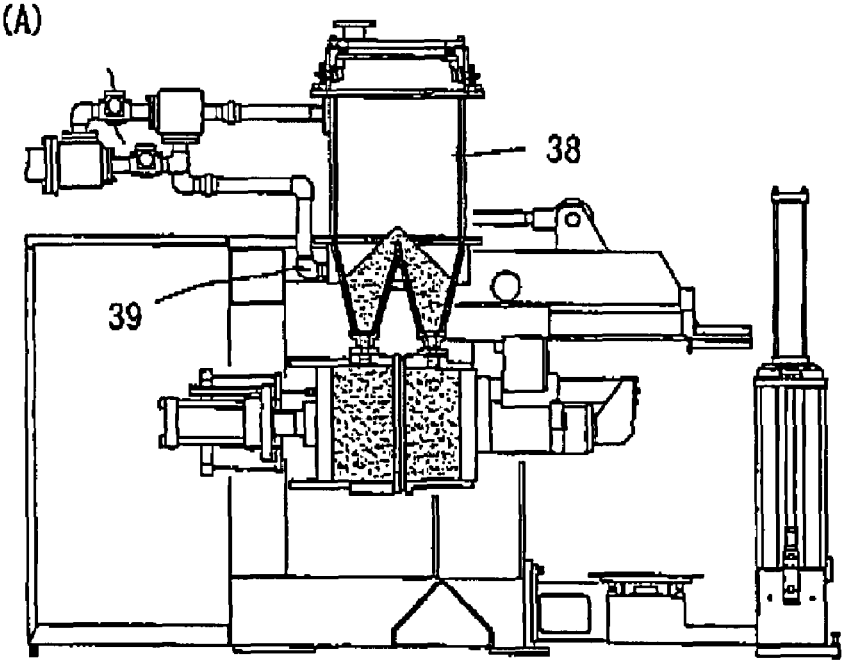
Figure 7:
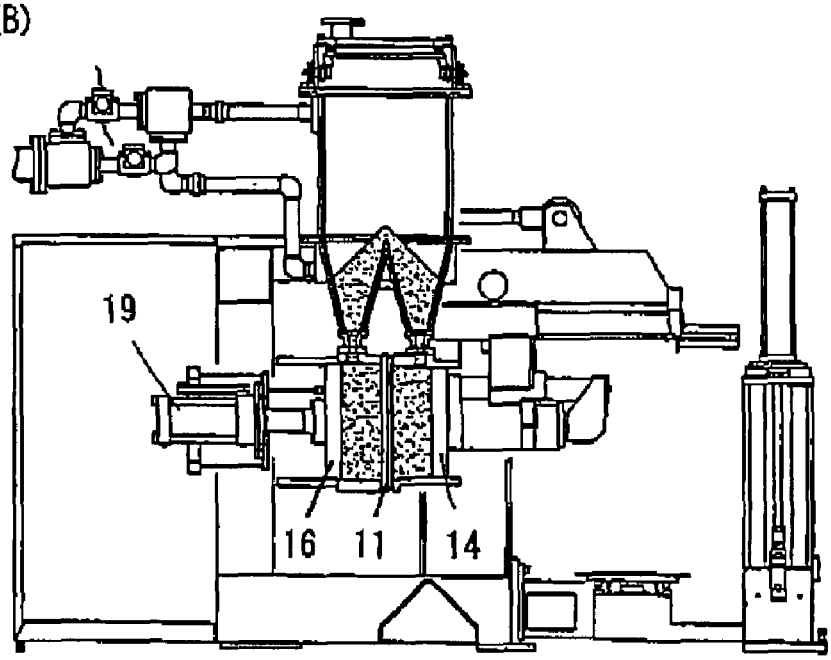

FIGS. 7 (A) and (B) illustrate the continuous process of filling molding sand within the molding spaces and squeezing the filled molding sand by using the molding machine of FIG. L.

Figure 8:
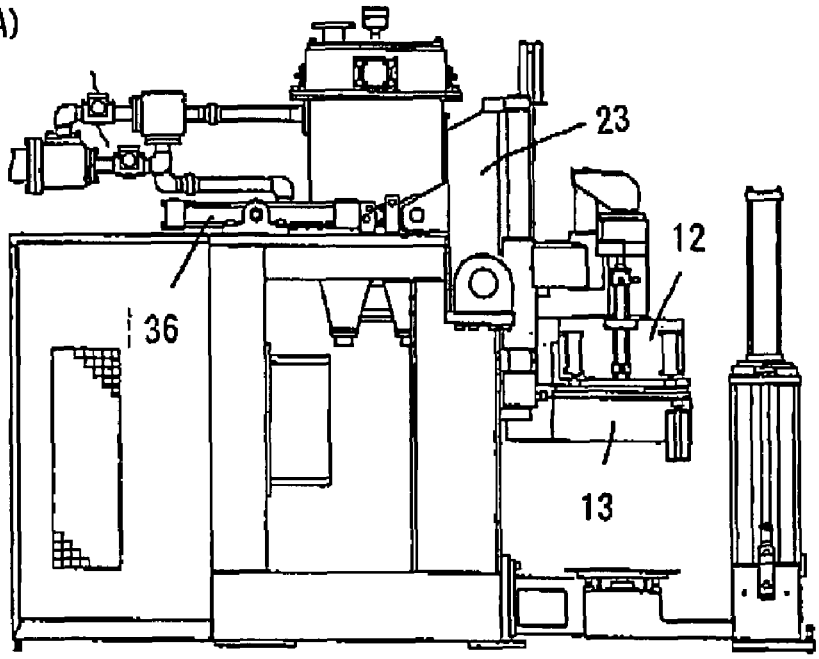
Figure 8:
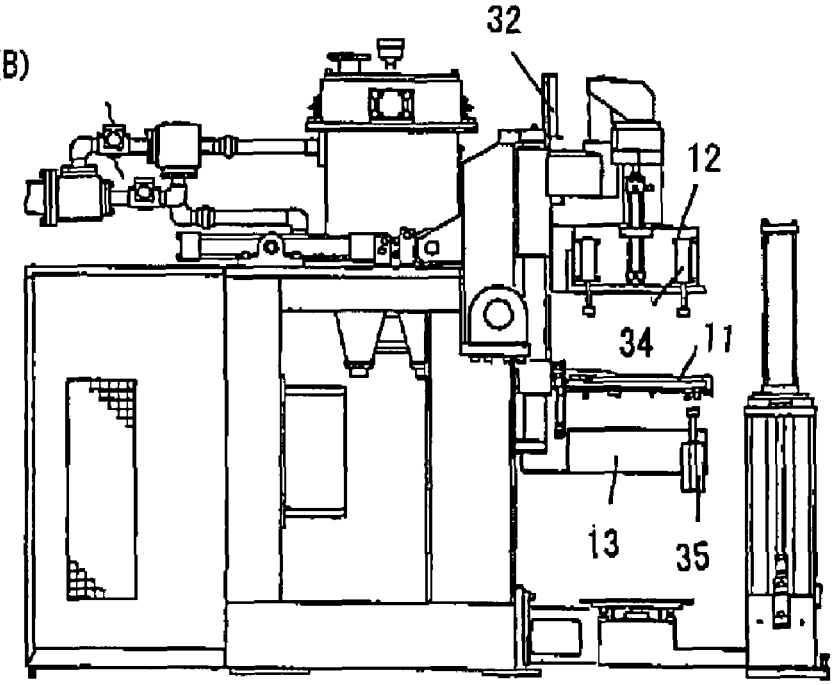

FIGS. 8 (A) and (B) illustrate the continuous process of removing a match plate from a pair of flasks with the molding machine of FIG. 1.

Figure 9:
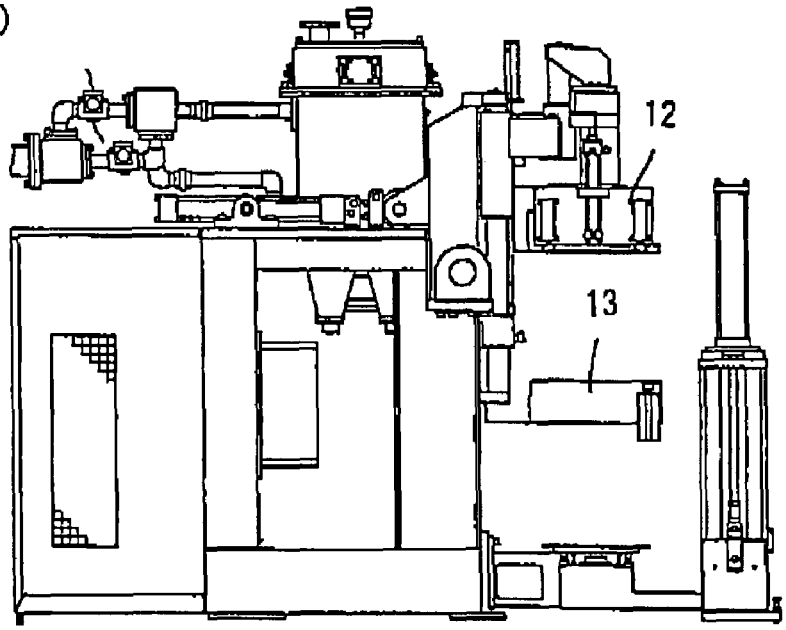
Figure 9:
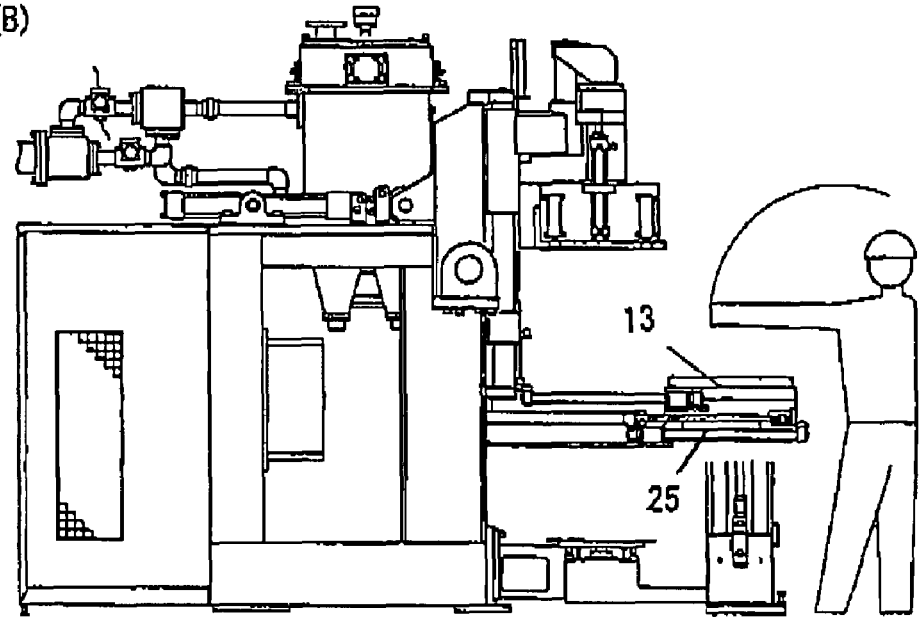

FIGS. 9 (A) and (B) illustrate the process of carrying out the match plate from the molding machine, and placing a core on a lower mold within the drag flask with the molding machine of FIG. 1.

DESCRIPTIONS OF THE PREFERRED EMBODIMENT

FIGS. 1 to 4 show one embodiment of the flaskless molding machine of the present invention. The flaskless molding machine generally includes a main unit 1 on a machinery mount 20 of the machine, and a shuttle 2 (FIG. 3) for carrying in and carrying out an exchangeable match plate 11 (FIG. 2) between a cope flask 12 and a drag flask 13 of the main unit 1. The sidewall of each flask 12 or 13 has ports to fill molding sand. Both faces of the match plate 11 are fixed with patterns. The cope flask 12, the drag flask 13, and the match plate 11 that is held therebetween constitute a flask assembly.

The molding machine in the illustrated embodiment further comprises mold-stripping equipment 3 for stripping the resulting upper and lower molds that are made in the main unit 1 from the cope and the drag flasks 12 and 13.

1. Main Unit of Molding Machine

Figure 2:
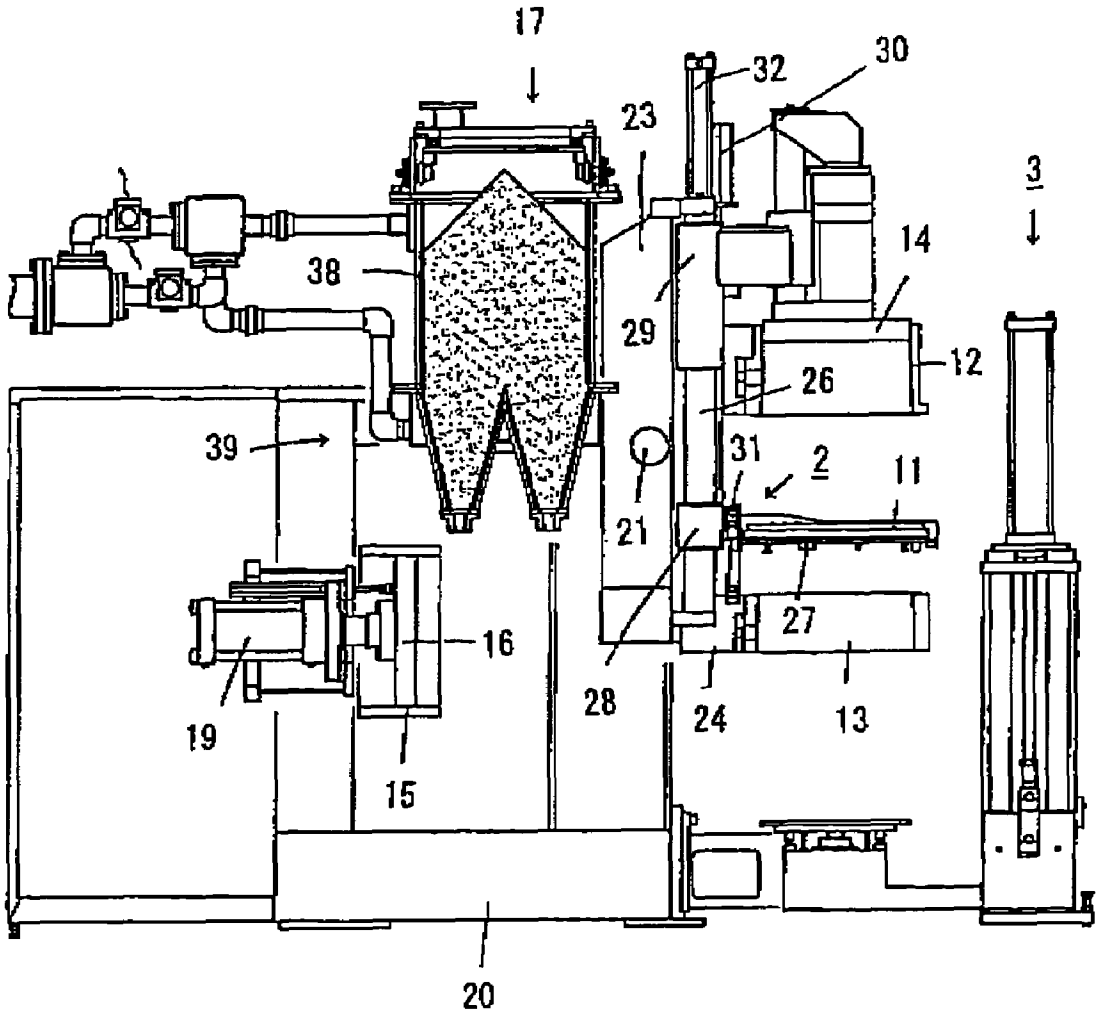
FIG. 2 is a front view, partly in cross section, of the molding machine of FIG. 1.

On the molding machine of the present invention, first the main unit 1 of it will be described. As is best shown in FIG. 2, the main unit 1 includes the flask assembly (that comprises the cope flask 12, the drag flask 13, and the exchangeable match plate 11 that is held therebetween). The main unit 1 also includes an upper squeeze member 14 that is insertable in the cope flask of the flask assembly to oppose the upper face of the match plate 11, a filling frame 15 that is attached to the machinery mount 20 in its vertical position, and a lower squeeze member 16. The pressure-applying plane of the lower squeeze member 16 is oriented horizontally such that it is insertable into the filling frame 15.

FIG. 2 illustrates the initial state of the main unit 1. In this state, the match plate 11, the cope flask 12, the drag flask 13, and the upper squeeze member 14 are in their horizontal positions, where the pressure-applying plane of the upper squeeze member 14 is oriented downward in the vertical direction. The match plate 11, the cope flask 12, the drag flask 13, and the upper squeeze member 14 can be rotated to their vertical positions in unison, as described in more detail below.

In contrast, neither the filling frame 15 nor the lower squeeze member 16 can be rotated, and thus they are oriented horizontally and fixedly. The filling frame 15 is attached to the position in which it abuts the drag flask 13 when the cope flask 12, the drag flask 13, and the match plate 11, sandwiched therebetween, have been rotated in their vertical positions. The lower squeeze member 16 can be inserted into the drag flask 13 in its vertical position through the filling frame 15.

Arranged in the upper-center part of the main unit 1 is a sand-supplying device 17 for filling molding sand into a pair of molding spaces to be defined below the sand-supplying device 17. (In the state as in FIGS. 1 and 2, the molding spaces have not yet been defined.)

Figure 4:
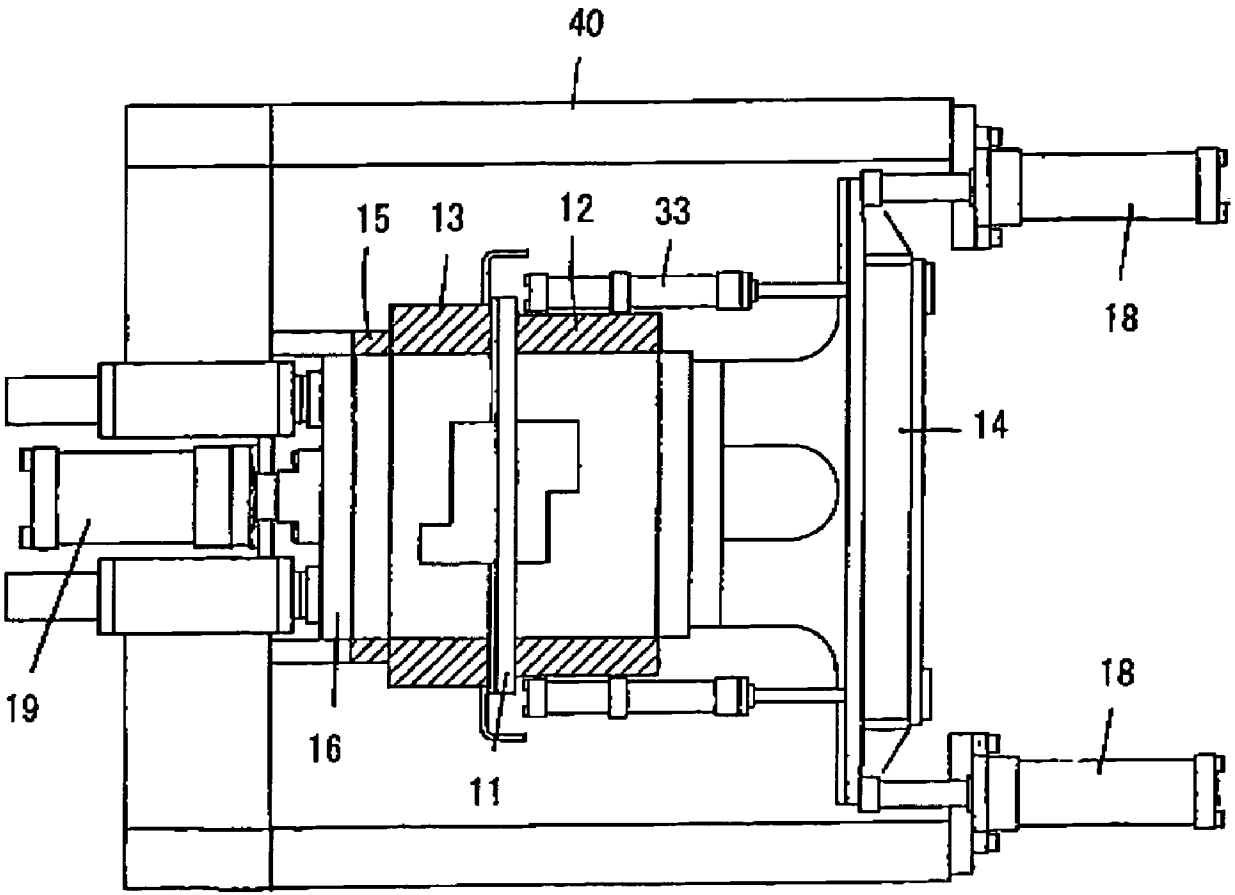
FIG. 4 is a top view of the molding machine of FIG. 1 with a pair of molding spaces defined by the molding machine and related elements.
Figure 5:
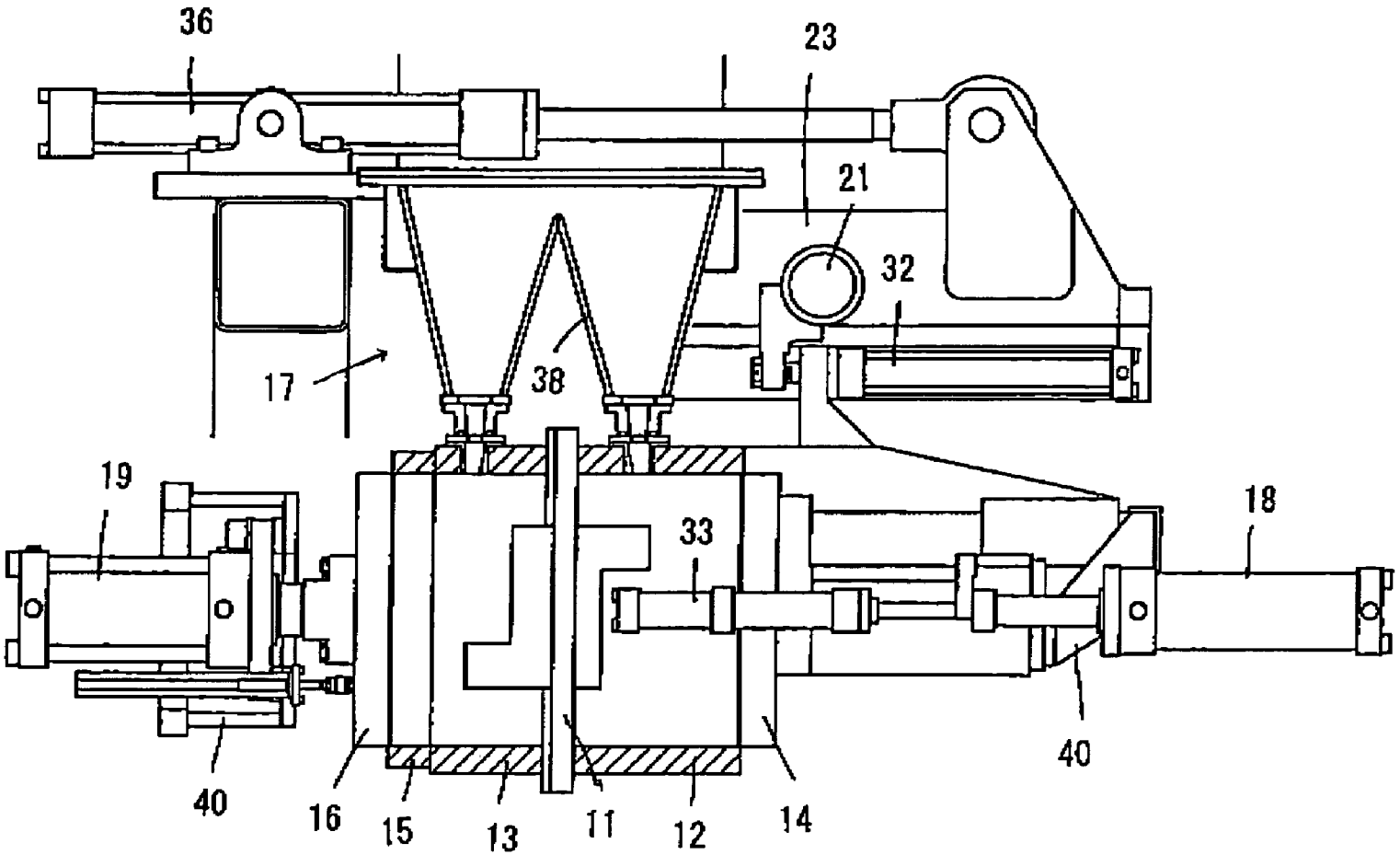
FIG. 5 is a front view, partly in cross section, of the molding machine of FIG. 1 with a pair of molding spaces defined by the molding machine and related elements.

As best shown in FIGS. 4 and 5, below and near the sand-supplying device, a pair of upper, transverse, actuators 18 and a lower, transverse, actuator 19 are opposed and arranged such that they operate the corresponding upper and lower squeeze members 14 and 16. Although the upper and lower actuators 18 and 19 in this embodiment are hydraulic cylinders, each cylinder may be replaced with an electric cylinder or a servo cylinder.

As shown in FIGS. 1 and 2, a rotating axis 21 is arranged at the upper right on the machinery mount 20 and extends in the crosswise direction of a main unit 1 (the perpendicular direction against the drawing plane of paper in FIGS. 1 and 2). In FIGS. 1 and 2, the rotating axis 21 is thus just only shown with its forward end. The rotating axis 21 is rotatably mounted with a pair of bearings 22 (just a front bearing 22 is shown in FIG. 1), which are mounted on the machinery mount 20 at a predetermined interval therebetween in the crosswise direction. Attached at about the center of the length of the rotating axis 21 is a pivotating frame 23, which extends substantially vertically.

Figure 3:
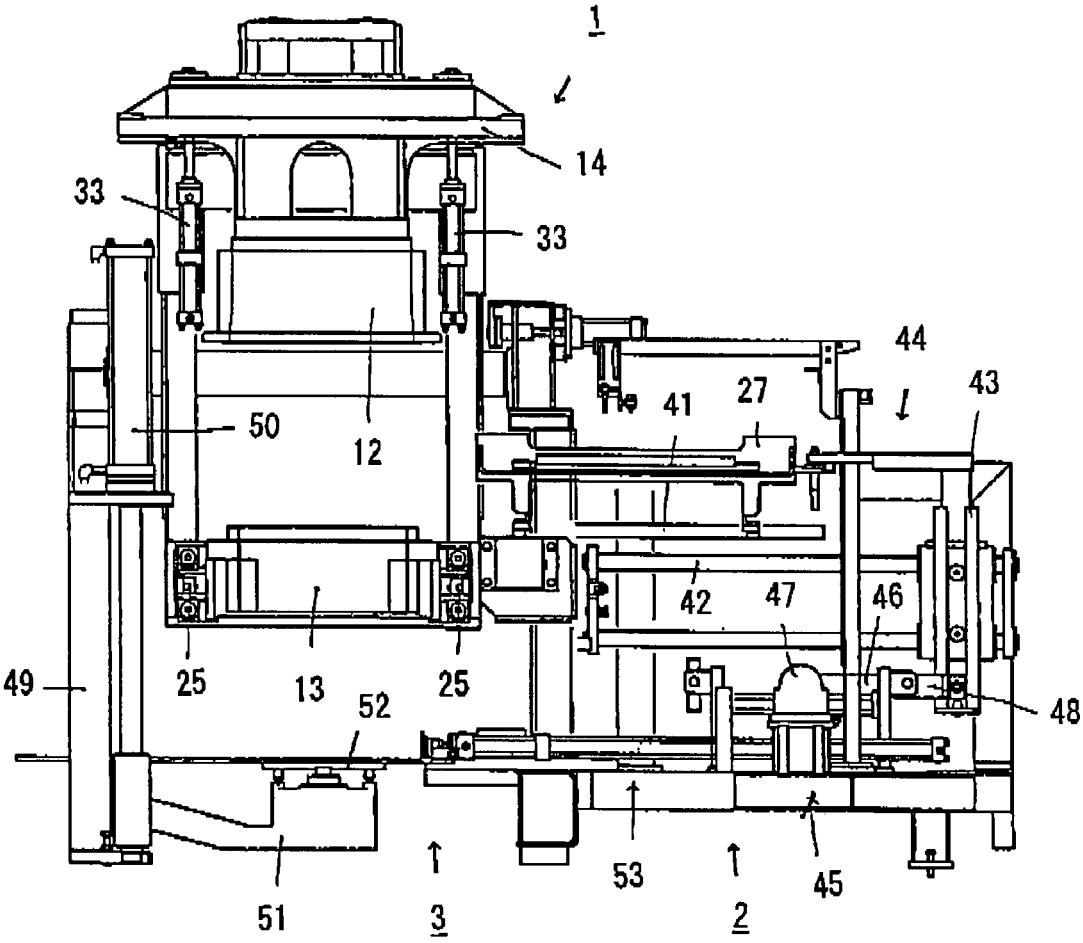
FIG. 3 is a right-side view of the molding machine of FIG. 1.

As best shown in FIG. 2, on the bottom of the right side of the pivoting frame 23, a pair of supporting members 24 is attached such that it extends rightward. As shown in FIG. 3, a pair of first, transverse, cylinders (transferring means) 25 is attached at a predetermined interval therebetween in the crosswise direction. The drag flask 13 is suspended from between the pair of the first cylinders 25 such that the drag flask 13 is reciprocately moved in a horizontal direction by extending and contracting motions of the first cylinders 25.

On the right side of the pivoting frame 23, a pair of guide rods 26 is attached at a predetermined interval therebetween in the lengthwise direction such that they extend substantially vertically. As shown in FIG. 2, a carrier plate 27, on which the match plate 11 will be placed, is slidably supported on the vertical guide rods 26 by means of a pair of guide holders 28 above the drag flask 13. Above the carrier plate 27, the cope flask 12 is also slidably supported on the vertical guide rods 26 by means of a pair of guide holders 29.

The carrier plate 27 is moveably supported on a guide rail 31, which is extended in the crosswise direction of the molding machine. The guide rail 31 can be moved up and down by extending and contracting motions of a second cylinder 30 mounted on the pivoting frame 23. The cope flask 12 is attached to a third, downwardly-facing, cylinder 32 by means of a supporting member (not shown). The distal end of the piston rod of the third cylinder 32 is attached to the pivoting frame 23 such that the cope flask 12 can be moved forward and backward relative to the carrier plate 27 by extending and contracting motions of the third cylinder 32.

As best shown in FIG. 1, a pair of fourth, transverse cylinders 33 is mounted on the center positions on both sides of the cope flask (just the front side of it is shown in FIG. 1). The upper squeeze member 14 is suspended between the distal ends of the piston rods of the fourth cylinders 33 such that the upper squeeze member 14 can be moved forward and backward relative to the cope flask 12 by extending and contracting motions of the fourth cylinders 33. The fourth cylinders 33 thus can be rotated in unison with the cope flask 12 and the upper squeeze member 14. Mounted on the corners of the back and front sides of the cope flask 12 are two pairs of fifth, downwardly-facing, cylinders 34 to push away the cope flask 12 from the match plate 11. Mounted on the back and front sides of the drag flask 13 (FIG. 2) are four of sixth, upwardly-facing, cylinders 35 to push away the drag flask 13 from the match plate 11.

As shown in FIG. 1, mounted on the front and rear sides of the upper plane of the machinery mount 20 is a pair of seventh, right-facing, cylinders 36. The upper part of the pivoting frame 23 is coupled between the distal ends of the piston rods of the seventh cylinders 36 by means of a coupling mechanism 37 such that the pivoting frame 23 pivotingly moves up and down about the rotating axis 21 by expanding and contracting motions of the seventh cylinders 36.

The sand-supplying device 17 of the main unit 1 is located on the machinery mount 20 between the pair of the seventh cylinders 36, as shown in FIG. 1. As shown in FIG. 2, attached below a sand tank 38 of the sand-supplying device 17 is a blowing nozzle or injector 39 for supplying compressed air to fluidize molding sand.

FIG. 5 (the plane view) and FIG. 6 (the front elevational view) illustrate the arrangement wherein the match plate 11, the cope and drag flasks 12 and 13, the upper and lower squeeze members 14 and 16, and the filling frame 15, define the upper and lower molding spaces in the state shown in FIGS. 1 and 2, as in the above-described manner. Thus the molding spaces and their associated elements are rotated immediately beneath the sand-supplying device 17. In FIGS. 5 and 6, a support framework 40, the plane cross section of which forms a substantially "C" shape, is installed in the machinery mount 20 (FIGS. 1 and 2) under the sand-supplying device 17 (FIG. 6).

As best shown in FIG. 5, the filling frame 15 in its vertical position is fixed to the inside of a left-side frame of the support framework 40 such that the filling frame 15 will abut the drag flask 13 when the lower molding space is defined. The lower single actuator 19, which is discussed above, is mounted on the center portion of the frame in the left side of the support framework 40 such that the lower actuator 19 faces rightward. The distal end of the piston rod of the lower actuator 19 is fixed to the lower squeeze member 16 in its vertical position. Each upper actuator 18, which is discussed above, is mounted on a pair of the open ends of the support framework 40 such that each upper actuator 11 faces left.

2. Shuttle for Match Plate

The shuttle 2 of the molding machine of the present invention will now be described. The shuttle 2 is located behind the main unit 1 shown in FIGS. 1 and 2.

As shown in FIG. 3 (the right-side view of the molding machine), the shuttle 2 includes a rail 41 for leading the carrier plate 27 for the match plate 11 (FIG. 2) into a space between the cope flask 12 and the drag flask 13. The shuttle 2 also includes two horizontal tie bars 42. They extend forward and backward (this corresponds to the lateral direction in FIG. 4) of the machine. They are mounted on the machinery mount 20 of the main unit 1 with a predetermined interval therebetween in the vertical direction under the rail 41. The shuttle 2 also includes a movable member 43 that is slidably mounted on the tie bars 42 such that it can reciprocate along them. The shuttle 2 also includes a connector 44 for detachably connecting a movable member 43 to the carrier plate 27. The shuttle 2 also includes a driving mechanism 45 to reciprocate the movable member 43 along the tie bars 42. The driving mechanism 45 includes a driver 47 having a pivoting arm 46 that can pivot forward and backward. The distal end of the pivoting arm 46 is coupled to the movable member 43 via a connector 48. By driving the driver 47, the reciprocating and pivoting motion of the pivoting arm 46 causes the carrier plate 27 to reciprocate forward and backward by means of the movable member 43.

3. Mold-stripping Equipment

The mold-stripping equipment 3, for stripping the flasks of the molding machine of the invention, will now be described. The mold-stripping equipment 3 is arranged at the lower-right part in FIGS. 1 and 2.

As shown in FIG. 3, the mold-stripping equipment 3 includes a pair of eighth, downwardly-facing, cylinders 50 that are suspended from the machinery mount 20 by a supporting member 49. The piston rods of the eighth cylinders 50 are attached to an elevating frame 51 that moves up and down.

Located above the elevating frame 51 that moves up and down of the mold-stripping equipment 3 is a receiver 52 for receiving the stacked upper and lower molds, which are stripped from the stacked cope and drag flasks 12 and 13. The mold-stripping equipment 3 also includes an extruder 53 for extruding the stacked upper and lower molds on the receiver 52.

Process for Making an Upper Mold and a Lower Mold with the Molding Machine

By referring to FIGS. 6 to 9, the procedure will now be explained for making an upper flaskless mold and a lower flaskless mold in their stacked state as shown FIGS. 1 and 2, using the molding machine as shown in FIGS. 1 to 6 of the present invention.

First, the third, downwardly-facing, cylinder 32 of the main unit 1 is contracted such that the drag flask 13, the match plate 11, and the cope flask 12 are stacked in this order in their substantially horizontal positions. Consequently, the match plate 11 is sandwiched and held between the cope flask 12 and the drag flask 13 (FIG. 6 (A)).

The upper actuator 18 of the main unit 1 is then contracted, while the pair of the seventh cylinders 36 of the main unit 1 are extended to rotate the pivoting frame 23 clockwise about the rotating axis 21. Consequently, the cope flask 12 and the drag flask 13, with the match plate 11 sandwiched therebetween, and the upper squeeze member 14, are transported between the upper actuator 18 and the filling frame 15 in their vertical positions. Simultaneously with this rotation, or pivoting motion, the lower actuator 19 is extended in a predetermined range, and the pair of the fourth cylinders 33 is contracted, to start defining the upper and lower molding spaces as shown in FIG. 4. More particularly, at the state where the cope flask 12 and the drag flask 13 sandwich and hold the match plate 11 therebetween, the upper squeeze member 14 is inserted in the cope flask 12 opposite the match plate 11, and thus the upper molding space is defined. Because the cope flask 12 and the drag flask 13, with the match plate 11 sandwiched therebetween, and the upper squeeze member 14, and the associated fourth cylinders 33 for driving it, can be rotated in unison, the upper molding space can be defined during its rotating motion. At the same time as this rotating motion occurs, the lower actuator 19 is extended such that the lower squeeze member 16 is inserted through the filling frame 15 and the approaching drag flask 13. Its approach is caused by the rotating motion in its substantially vertical position. The lower molding space is also defined when the rotating motion has been completed and thus the drag flask 13 abuts the filling frame 15 (FIG. 6 (B)). This means that the time required for defining the molding spaces, and thus for the molding, can be considerably shortened compared to the conventional molding machine.

Compressed air is then supplied from a source (not shown) into the injector 39, which injects the air for fluidizing the molding sand, of the sand tank 38, to fill the upper and lower molding spaces with the molding sand by means of the compressed air (FIG. 7 (A)). Preferably, but this is not a limiting aspect of the present invention, to shorten the time needed to fill the molding spaces with the molding sand, the compressed air may also be introduced in the sand tank 38 during the filling of the molding sand.

The upper actuator 18 and the lower actuators 19 are then extended to move the upper squeeze member 14 and the lower squeeze member 16 to the match plate 11 to squeeze the molding sand within the upper and lower molding spaces (FIG. 7 (B)). This squeezing process forms an upper mold and a lower mold within the upper and lower molding spaces.

The seventh cylinders 36 are then contracted to rotate the pivoting frame 23 counterclockwise, to swivel the cope flask 12 and the drag flask 13, in which the corresponding upper mold and the corresponding lower mold are contained, to the mold-stripping equipment 3 (FIG. 6(A)).

The third cylinders 32 are then extended to lift the cope flask 12, while the fifth cylinders 34 are extended to strip the match plate 11 from the cope flask 12. At the same time, the sixth cylinders 35 are extended to strip the match plate 11 from the drag flask 13 (FIG. 9(B)).

In this step, preferably the lifting velocity of the cope flask 12 caused by the extensions of the third cylinders 32 is about twice the velocity of the separation, in which the match plate 11 is striped from the drag flask 13 by the extensions of the sixth cylinders 35. This results in the velocity of the separation, in which the match plate 11 is separated from the cope flask 12, being able to be substantially the same as that in which the match plate 11 is separated from the drag flask 13.

The driver 47 of the driving mechanism 45 is then operated to reversely rotate the pivoting arm 46 such that the movable member 43 and the carrier plate 27 reciprocating crosswise to remove the match plate 11 from between the cope flask 12 and drag flask 13 (FIG. 9(A)).

Consequently, a core may be manually placed by an operator in the mold within the drag flask 13, if desired (FIG. 9 (B)). To achieve this, the first cylinders 25 are extended to move the drag flask 13 into the lateral side (the operator side) of the main unit 1 relative to the cope flask 12. Because an open apace exists above the drag flask 13 in this state, the cope flask 12 cannot affect the operator when he or she tries to place the core in the lower mold within the drag flask 13. Therefore, the core can be readily placed in the lower mold within the drag flask 13. After the core is placed in the lower mold within the drag flask 13, the first cylinders 25 are contracted to move back the drag flask 13 in a place that is located immediately beneath the cope flask 12. If no core in place is required, the process shown in FIG. 9(B) can be omitted.

The third cylinders 32 are then contracted to lower the cope flask 12 so as to stack it on the drag flask 13. The eighth cylinders 50 of the mold-stripping equipment 3 are then contracted to raise the receiver 52 by means of the elevating frame 51 so as to have it abut the bottom of the lower mold. The fourth cylinders 33 are then contracted so as to by push downward the mold within the cope flask 12 by means of the upper squeeze member 14. Simultaneously, the eighth cylinders 50 are extended to lower the receiver 52 by means of the elevating frame 51 to pull out the upper mold and the lower mold from the cope flask 12 and the drag flask 13. The fourth cylinders 33 are then extended to raise the upper squeeze member 14.

The extruder 53 is then operated to push out the stacked upper and lower molds on the receiver 52. Consequently, stacked, flaskless upper and lower molds are obtained.

Although the present invention has been described above in reference to an exemplified embodiment, the invention is not intended to be limited to the particulars disclosed herein. Those skilled in the art will recognize that many variations or modifications can be made within the spirit and scope of the present invention, which is defined by the appended claims.

The invention claimed is:

1. A molding machine to make a pair of flaskless molds, comprising:

a flask assembly that includes a cope flask, a drag flask, and an exchangeable match plate having upper and lower faces that are formed with patterns and that excludes a filling frame and a lower squeeze member;

means for relatively moving said cope and drag flasks to the match plate of the flask assembly such that the cope and drag flasks can hold and release the match plate being held therebetween;

an upper squeeze member having a pressure-applying plane, wherein said upper squeeze member is insertable into the cope flask of the flask assembly while the pressure-applying plane is opposed to the upper face of the match plate such that an upper molding space is defined by the pressure-applying plane, the upper face of the match plate, and the cope flask;

supporting means for supporting the flask assembly and the upper squeeze member, and for rotating them in unison between a horizontal position in which the pressure-applying plane of the upper squeeze member is oriented vertically and facing downward and a vertical position in which the pressure-applying plane is oriented horizontally;

the filling frame located to abut the drag flask in a perpendicular position when the flask assembly is in the vertical position;

the lower squeeze member having a pressure-applying plane that is oriented horizontally, wherein the lower squeeze member is insertable into the filling frame, and wherein the lower squeeze member is insertable into the drag flask through the filling frame while the pressure-applying plane of the lower squeeze member is opposed to the lower face of the match plate when the flask assembly is in the vertical position such that a lower molding space is defined by the pressure-applying plane, the lower face of the match plate, the filling frame, and the drag flask;

an upper actuator to move the upper squeeze member to the upper face of the match plate such that molding sand within the upper molding space is squeezed by the pressure-applying plane of the inserted upper squeeze member;

a lower actuator to move the lower squeeze member to the lower face of the match plate such that molding sand within the lower molding space is squeezed by the pressure-applying plane of the lower squeeze member;

means for carrying in the match plate to between the cope flask and the drag flask at the horizontal position, and for carrying out the match plate from therebetween; and means for laterally moving the drag flask relative to the cope flask into the lateral side of the molding machine, after the match plate is carried out from between the cope flask and the drag flask.

2. The molding machine of claim 1, wherein the upper molding space is defined by the pressure-applying plane of the upper squeeze member, the upper face of the match plate, and the cope flask, while the cope and drag flasks, the match plate, and the upper squeeze member are rotated from the horizontal position to the vertical position.

3. The molding machine of claim 1 or 2, wherein the lower squeeze member initiates the insertion into the filling frame while the rotation from the horizontal position to the vertical position is carried out, and wherein the lower molding space is defined by the pressure-applying plane of the lower squeeze member, the lower face of the match plate, and the drag flask when the filling frame abuts the drag flask.

4. The molding machine of claim 1 or 2, wherein the upper and lower actuators include a hydraulic cylinder, an electric cylinder, or a servo cylinder.

5. The molding machine of claim 1 or 2, wherein the cope and drag flasks have sand-filling ports on their side walls for supplying molding sand, and wherein the molding machine further includes means for introducing by air the molding sand into the defined upper and lower molding spaces through the sand-filling ports.

6. The molding machine of claim 5, wherein said means for introducing the molding sand includes a fluidizing mechanism for fluidizing the molding sand with a flow of compressed air.

7. The molding machine of claim 1 or 2, wherein it further comprises means for stripping a pair of the molds from the cope and drag flasks.

8. The molding machine of claim 7, wherein said means for stripping a pair of the molds includes means for pushing out the molds from the cope flask and the drag flask, which are in a stacked relationship, and which contain a pair of the molds.

* * * * *